US010483693B2

(12) United States Patent
Pan et al.

(10) Patent No.: US 10,483,693 B2
(45) Date of Patent: Nov. 19, 2019

(54) SLIDING CONTACT ASSEMBLY FOR ACCELERATING RELATIVE SEPARATION SPEED BETWEEN PLUG CONTACTS AND SOCKET OUTLET CONTACTS

(71) Applicant: ABB Schweiz AG, Baden (CH)

(72) Inventors: Zhiguo Pan, Cary, NC (US); Yu Du, Raleigh, NC (US); Emanuele Borla, Vittuone (IT); Rajib Mikail, Raleigh, NC (US); Hongrae Kim, Cary, NC (US)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/762,107

(22) PCT Filed: Sep. 24, 2015

(86) PCT No.: PCT/US2015/051877
§ 371 (c)(1),
(2) Date: Mar. 22, 2018

(87) PCT Pub. No.: WO2017/052545
PCT Pub. Date: Mar. 30, 2017

(65) Prior Publication Data

US 2018/0277993 A1 Sep. 27, 2018

(51) Int. Cl.
*H01R 13/53* (2006.01)
*H01R 13/635* (2006.01)
(Continued)

(52) U.S. Cl.
CPC ..... *H01R 13/635* (2013.01); *H01R 13/14* (2013.01); *H01R 24/78* (2013.01); *H01R 13/502* (2013.01);
(Continued)

(58) Field of Classification Search
CPC .. H01R 13/635; H01R 13/14; H01R 2103/00; H01R 24/78; H01R 24/28
See application file for complete search history.

(56) References Cited

U.S. PATENT DOCUMENTS 5,266,040 A * 11/1993 Merrill ..... H01R 13/635 439/159
6,327,162 B1 12/2001 Larsen et al.
(Continued)

FOREIGN PATENT DOCUMENTS

CN 101789555 A 7/2010
CN 201766190 U 3/2011
(Continued)

OTHER PUBLICATIONS

International Search Report and Written Opinion in PCT/US2015/051877 dated Jun. 15, 2016.
(Continued)

*Primary Examiner* — Xuong M Chung Trans
(74) *Attorney, Agent, or Firm* — Barnes & Thornburg LLP

(57) ABSTRACT

A sliding contact assembly for a DC electrical outlet receives plug contacts of an electrical plug. The assembly includes sliding contact structure having a base and a plurality of electrical sliding contacts fixed to the base. A housing includes a first end wall having an internal top surface and second end wall opposing the first end wall. The second end wall has an internal bottom surface. The housing has a side wall structure defining an internal chamber between the top surface and the bottom surface. The sliding contact structure is disposed in the housing to be movable linearly within the chamber. A spring is disposed between the top surface of the housing and a surface of the base so that when the plug contacts are completely disconnected from the associated sliding contacts, the spring rapidly
(Continued)

forces the sliding contacts away from the plug contacts, reducing arcing energy there-between.

20 Claims, 5 Drawing Sheets

(51) Int. Cl.

| | |
|---|---|
| ***H01R 24/78*** | (2011.01) |
| ***H01R 13/14*** | (2006.01) |
| *H01R 103/00* | (2006.01) |
| *H01R 24/28* | (2011.01) |
| *H01R 13/502* | (2006.01) |
| *H01R 13/66* | (2006.01) |
| *H01R 24/76* | (2011.01) |

(52) U.S. Cl.
CPC ..... *H01R 13/6633* (2013.01); *H01R 24/28* (2013.01); *H01R 24/76* (2013.01); *H01R 2103/00* (2013.01)

(56) References Cited

U.S. PATENT DOCUMENTS

| | | | | |
|---|---|---|---|---|
| 6,488,549 | B1 | 12/2002 | Weller et al. | |
| 6,746,258 | B2 | 6/2004 | Kikuchi et al. | |
| 8,277,237 | B1 | 10/2012 | Cherrish | |
| 8,410,752 | B2 * | 4/2013 | Sulem ..... | H02J 7/0042 320/111 |
| 2003/0027447 | A1 | 2/2003 | Cooper et al. | |
| 2005/0106912 | A1 | 5/2005 | Hsu | |
| 2005/0184592 | A1 | 8/2005 | Marwali et al. | |
| 2010/0264743 | A1 | 10/2010 | Jung et al. | |
| 2011/0122663 | A1 | 5/2011 | Huang | |
| 2011/0124218 | A1 | 5/2011 | Huang | |
| 2012/0050928 | A1 | 3/2012 | Johnson, Jr. | |
| 2012/0200280 | A1 | 8/2012 | Jin et al. | |

FOREIGN PATENT DOCUMENTS

| | | | |
|---|---|---|---|
| CN | 201805036 | U | 4/2011 |
| CN | 101854051 | A | 10/2011 |
| CN | 102496505 | | 6/2012 |
| DE | 10225259 | B3 | 1/2004 |
| DE | 102011109920 | A1 | 2/2013 |
| EP | 1286429 | A2 | 2/2003 |
| EP | 2161793 | A1 | 3/2010 |
| EP | 2251941 | A1 | 11/2010 |
| EP | 2551967 | A1 | 1/2013 |
| EP | 2595252 | A1 | 5/2013 |
| EP | 2736147 | A1 | 5/2014 |
| FR | 2934721 | A1 | 2/2010 |
| JP | 3274688 | A | 12/1991 |
| JP | 2000014046 | A | 1/2000 |
| JP | 2004158331 | A | 6/2004 |
| JP | 2004158332 | A | 6/2004 |
| JP | 2005108451 | A | 4/2005 |
| JP | 2005294077 | A | 10/2005 |
| JP | 2009146777 | A | 7/2009 |
| JP | 2009146778 | A | 7/2009 |
| JP | 2009146779 | A | 7/2009 |
| JP | 2009146780 | A | 7/2009 |
| JP | 2009146781 | A | 7/2009 |
| JP | 2009146782 | A | 7/2009 |
| JP | 2009146783 | A | 7/2009 |
| JP | 2010213479 | A | 9/2010 |
| JP | 2011003409 | A | 1/2011 |
| JP | 2011034687 | A | 2/2011 |
| JP | 2011124098 | A | 6/2011 |
| JP | 2011142768 | A | 7/2011 |
| JP | 2011146328 | A | 7/2011 |
| JP | 2011258511 | A | 12/2011 |
| JP | 2012119105 | A | 6/2012 |
| JP | 2012119106 | A | 6/2012 |
| JP | 2012209210 | A | 10/2012 |
| WO | 2010147008 | A1 | 12/2010 |
| WO | 2012035387 | A1 | 3/2012 |
| WO | 2012038797 | A1 | 3/2012 |
| WO | 2012063528 | A1 | 5/2012 |
| WO | 2014209143 | A1 | 12/2014 |

OTHER PUBLICATIONS

Iino et al., Development of 400 Vdc Plug and Socket-Outlet for DC Distribution System, IEEE, 15.1, 2012.

Baek et al., Development of plug and socket-outlet for 400 volts direct current distribution system, 8th International Conference on Power Electronics-ECCE Asia, IEEE, 2011.

International Search Report and Written Opinion, International Application No. PCT/US2016/056712, dated Jan. 4, 2017, 14 pages.

Electrical Plug and Outlet for the DC Distribution System in Buildings, Authors: Kittiphan Techakittiroj, Affiliation: Assumption University of Thailand, Bangkok, Thailand, Source: In International Conference on Control, Automation and Systems, ICCAS 2008, vol., No., pp. 2667-2670, Oct. 14-17, 2008, 4 pages.

Anderson Power Products (APP), Saf-D-Grid, 600V DC Receptacle & Power Cord, 1 page.

Fujitsu Component Limited and NTT Facilities, Inc., Development of DC plugs and socket outlets for smart grid and data center, Nov. 9, 2010, web page: http://www.fujitsu.com/jp/group/fcl/en/resources/news/press-releases/2010/20101109-1.html, 3 pages.

Direct Power Technologies Inc. (DPTI), 380/400VDC Plug Strip (Slide 52), Overseas Development of 400VDC Connectors (Slide 53), web page: http://www.directpowertech.com/docs/DC-PRESENTATON.pdf, 67 pages.

Rong Feng Industrial Co., Ltd., High Voltage Socket, web page: http://www.rongfeng.com.tw/highvoltag.htm, 1 page.

* cited by examiner

SLIDING CONTACT ASSEMBLY FOR ACCELERATING RELATIVE SEPARATION SPEED BETWEEN PLUG CONTACTS AND SOCKET OUTLET CONTACTS

FIELD

The embodiment relates electrical plug contacts and, more particularly, to a sliding contact assembly that maximizes separation speed between socket outlet contacts and the plug contacts.

BACKGROUND

In a traditional plug and socket outlet system, the electrical contacts are fixed and stationary within both the plug and socket outlet side, respectively. Therefore, the relative separation speed between the plug contacts and the outlet contacts is determined only by the manual removal speed of the plug. In addition, due to the uncertainty of the personnel who operates the device, the removal speed changes over a large range and essentially is not regulated.

One example application of such contacts is a direct current (DC) plug and socket outlet device. The new low voltage direct current (LVDC) socket outlet and plug devices are required by DC distribution applications such as DC datacenters, DC commercial buildings and residential houses, in order to distribute the power to the end equipment, appliances and electronics. Unlike the AC socket outlet and plug, there is no natural zero crossing instant for either voltage or current in the DC distribution system. When the plug is disconnected from the socket outlet with DC load current, significant arcing will be generated. While in the AC system, the arcing can be quenched automatically at the voltage/current zero crossing quickly. Without a proper extinction approach, DC arc generates a large amount of energy and heat that can be more than one kilo-Joule, and can last up to a few seconds if the plug is separated too slowly. Therefore, DC arcing can cause a fire hazard, injure personnel, damage the plug and socket outlet device, and greatly reduce the operating cycles of the outlet device with poor reliability. As a result, DC arcing extinction approaches must be considered for the DC plug and socket outlet device to guarantee safe and reliable connection and disconnection operations.

Newer DC socket outlets include an electromagnetic arc extinction unit to quench the arc when the plug is separated from the socket outlet. The magnetic field applied by an electro-magnet stretches the arc with Lorenz force and the arcing cannot sustain and is therefore extinguished quickly. However, even with the electro-magnet, some minimal separation speed between the plug and outlet side contacts is still required in order to keep the arcing energy in low level for both human safety and the life cycles of the device.

Thus, there is a need to provide sliding contact assembly that is constructed and arranged to ensure a certain separation speed between the plug and outlet side contacts.

SUMMARY

An object of the invention is to fulfill the need referred to above. In accordance with the principles of an embodiment, this objective is obtained by providing a sliding contact assembly for a DC electrical outlet. The sliding contact assembly is constructed and arranged to receive plug contacts of an electrical plug and includes sliding contact structure having a base and a plurality of electrical sliding contacts fixed to the base. A housing includes a first end wall having an internal top surface and second end wall opposing the first end wall. The second end wall has an internal bottom surface. The housing has side wall structure defining an internal chamber between the top surface and the bottom surface. The sliding contact structure is disposed in the housing so as be movable linearly within the chamber. At least one spring is disposed between the top surface of the housing and a surface of the base. When the housing is stationary and when 1) the plug contacts are engaged with the associated sliding contacts causing friction there-between, the at least one spring is constructed and arranged to bias the sliding contact structure to engage the bottom surface of the housing, 2) the plug contacts are being disconnected from the associated sliding contacts with friction there-between remaining, the at least one spring is constructed and arranged to compress and store energy, and 3) the plug contacts are completely disconnected from the associated sliding contacts with no friction there-between, the compressed spring is constructed arranged to rapidly force the sliding contacts away from the plug contacts, reducing arcing energy there-between.

In accordance with another aspect of an embodiment, a method of rapidly separating outlet contacts from plug contacts of an electrical plug at a DC electrical outlet provides a sliding contact assembly including a sliding contact structure having a base and a plurality of electrical sliding contacts fixed to the base and defining the outlet contacts. A housing defines an internal chamber with the sliding contact structure being disposed in the housing so as be movable linearly within the chamber. At least one spring is disposed between the housing and a surface of the base. The method couples the housing to a fixed member associated with the electrical outlet ensuring that the housing remains stationary and that the sliding contacts are accessible to the plug contacts, so that 1) when the plug contacts are engaged with the associated sliding contacts causing friction there-between, the at least one spring is constructed and arranged to bias the sliding contact structure to engage an internal bottom surface of the housing, 2) when the plug contacts are being disconnected from the associated sliding contacts with friction there-between remaining, the at least one spring is constructed and arranged to compress and store energy, and 3) when the plug contacts are completely disconnected from the associated sliding contacts with no friction there-between, the compressed spring is constructed arranged to rapidly force the sliding contacts away from the plug contacts, reducing arcing energy there-between.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF AN EXEMPLARY EMBODIMENT

Figure 1:
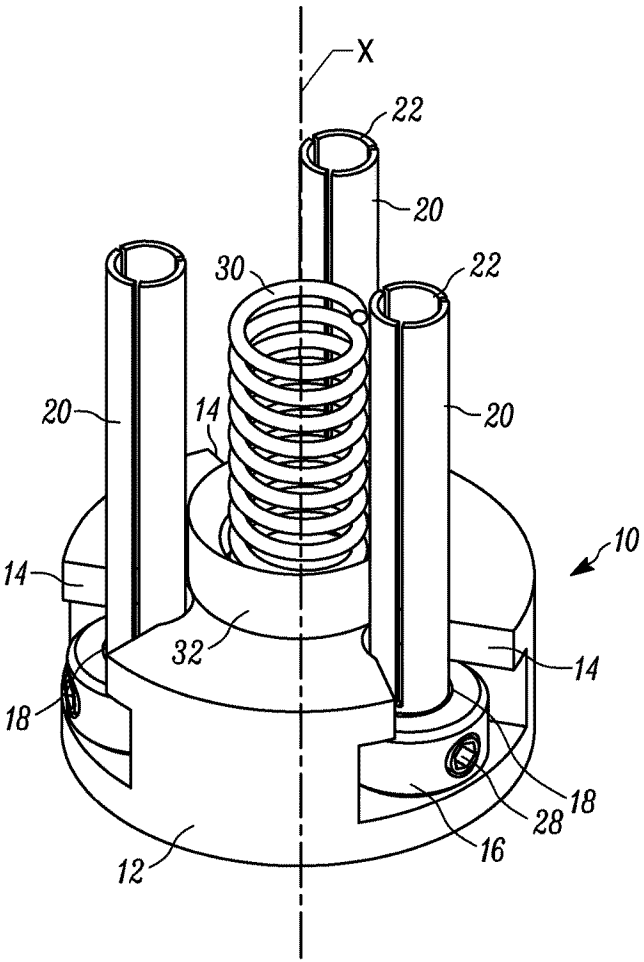
FIG. 1 is a perspective view of sliding contact structure provided in accordance with an embodiment.
Figure 3:
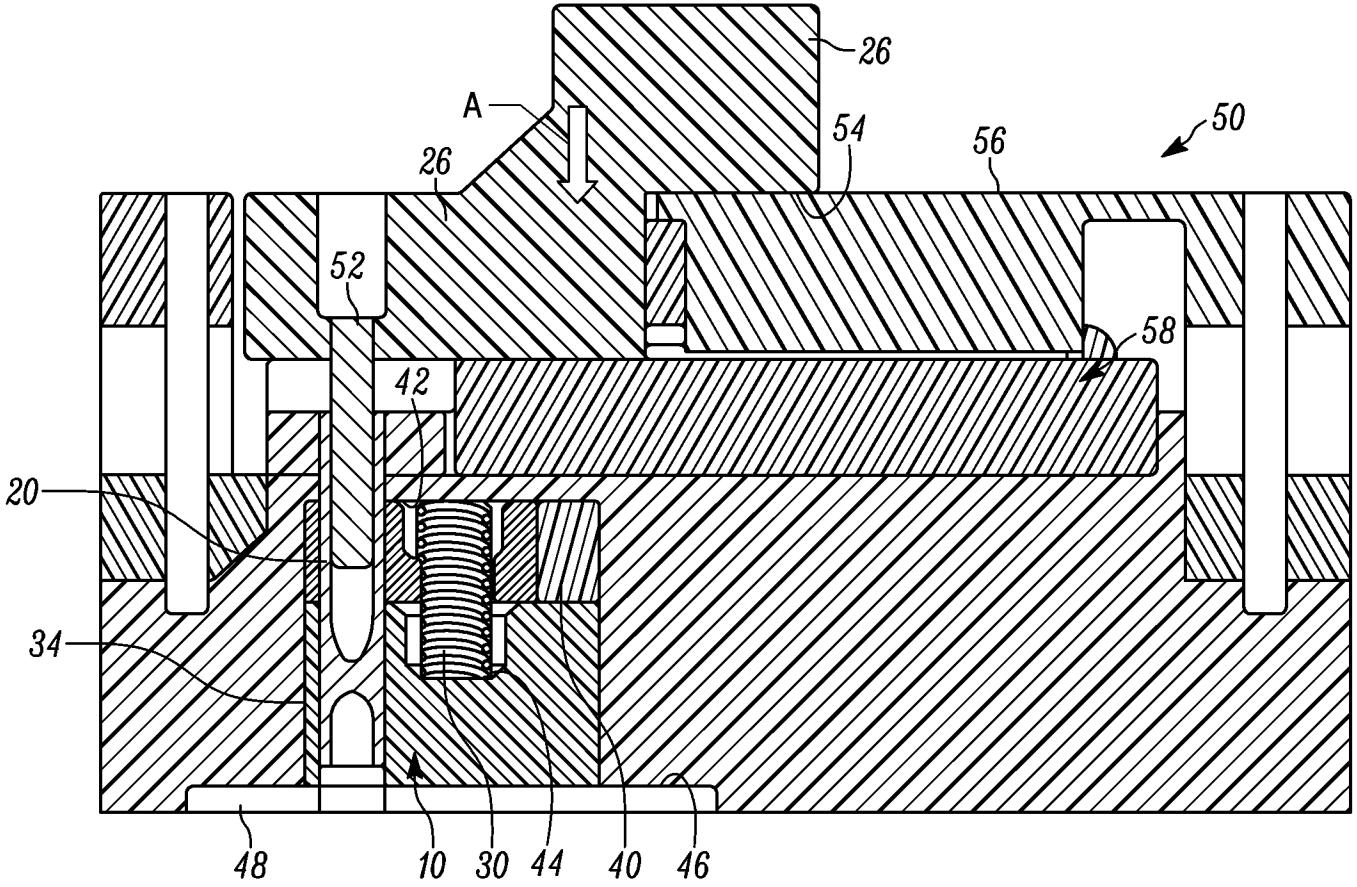
FIG. 3 is a cut-away view of a DC outlet showing a plug contact being inserted into a sliding contact of the sliding contact assembly of FIG. 2.

With reference to FIG. 1, an embodiment of sliding contact structure is shown, generally indicated at 10. The structure 10 includes a generally cylindrical base 12 having a plurality of cut-outs 14 therein. A boss 16 is provided in each cut-out 14 and each boss 16 is fixed to the base 12. Each boss 16 includes an opening 18 that receives a female sliding electrical contact 20. Thus, each sliding contact 20 is preferably a metal hollow tubular member having an open end 22. In the embodiment, three sliding contacts 20 are provided that are spaced so as to mate with conventional male contacts 52 of a plug 26 (FIG. 3). Each sliding contact 20 can be secured in the boss 16 by a set screw 28 or other fastener structure or can be molded together with the base 12. At least one coil spring 30 is provided and is preferably received in boss 32 of the base 12 that is located along the central axis X of the base.

Figure 2:
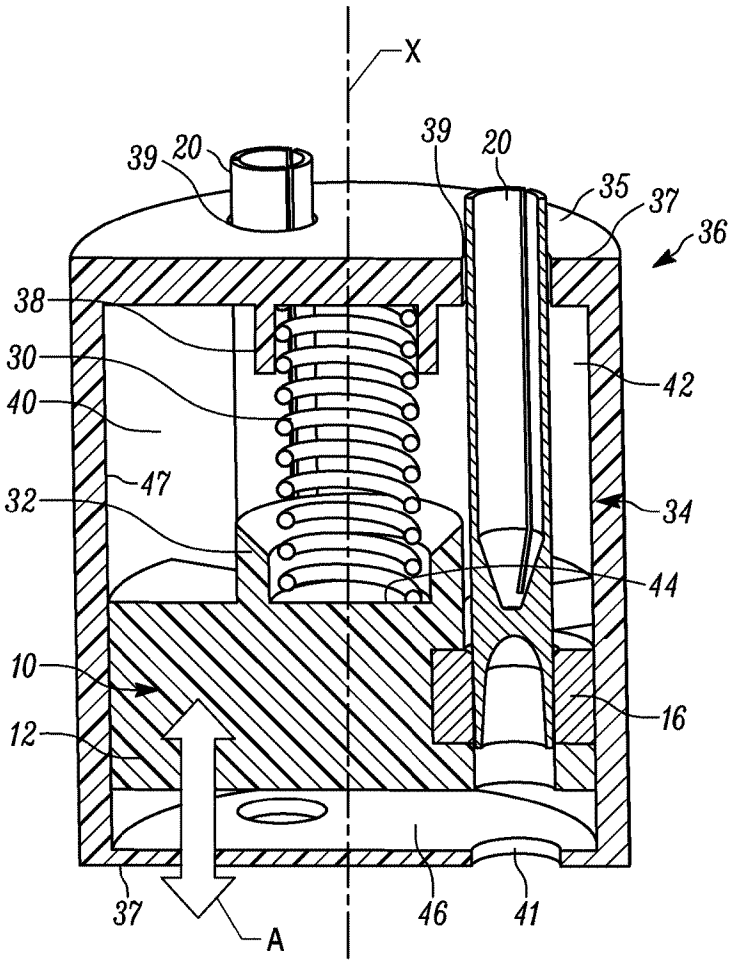
FIG. 2 is a cross-sectional view of a sliding contact assembly incorporating the sliding contact structure of FIG. 1 in a housing in accordance with an embodiment.

FIG. 2 shows the sliding contact structure 10 disposed in a stationary housing 34 to define a sliding contact assembly 36. The housing 34 includes a first end wall 35 and a second opposing end wall 37. An internal top surface 42 is defined by the first end wall 35 and an internal bottom surface 46 is defined by the second end wall 37. The housing 34 has a cylindrical side wall structure 47 that, with the first and second end walls, defines a substantially closed internal chamber 40 between the top surface 42 and the bottom surface 46. A centrally located boss 38 extends from the top surface 42 and receives the other end of the spring 30. Thus, the spring 30 is contained between the top surface 42 and a surface 44 of the base 12. The sliding contact structure 10 and thus the sliding contacts 20 can move linearly along axis X in the internal chamber 40 in the directions A in which the plug 26 (not shown in FIG. 2) is connected and disconnected. Thus, the first end wall 35 has openings 39 therein for each sliding contact 20 to pass there-through. The second end wall 37 preferably has openings 41 to accommodate the passage of wiring (not shown) that is connected to the associated sliding contact 20.

Figure 4:
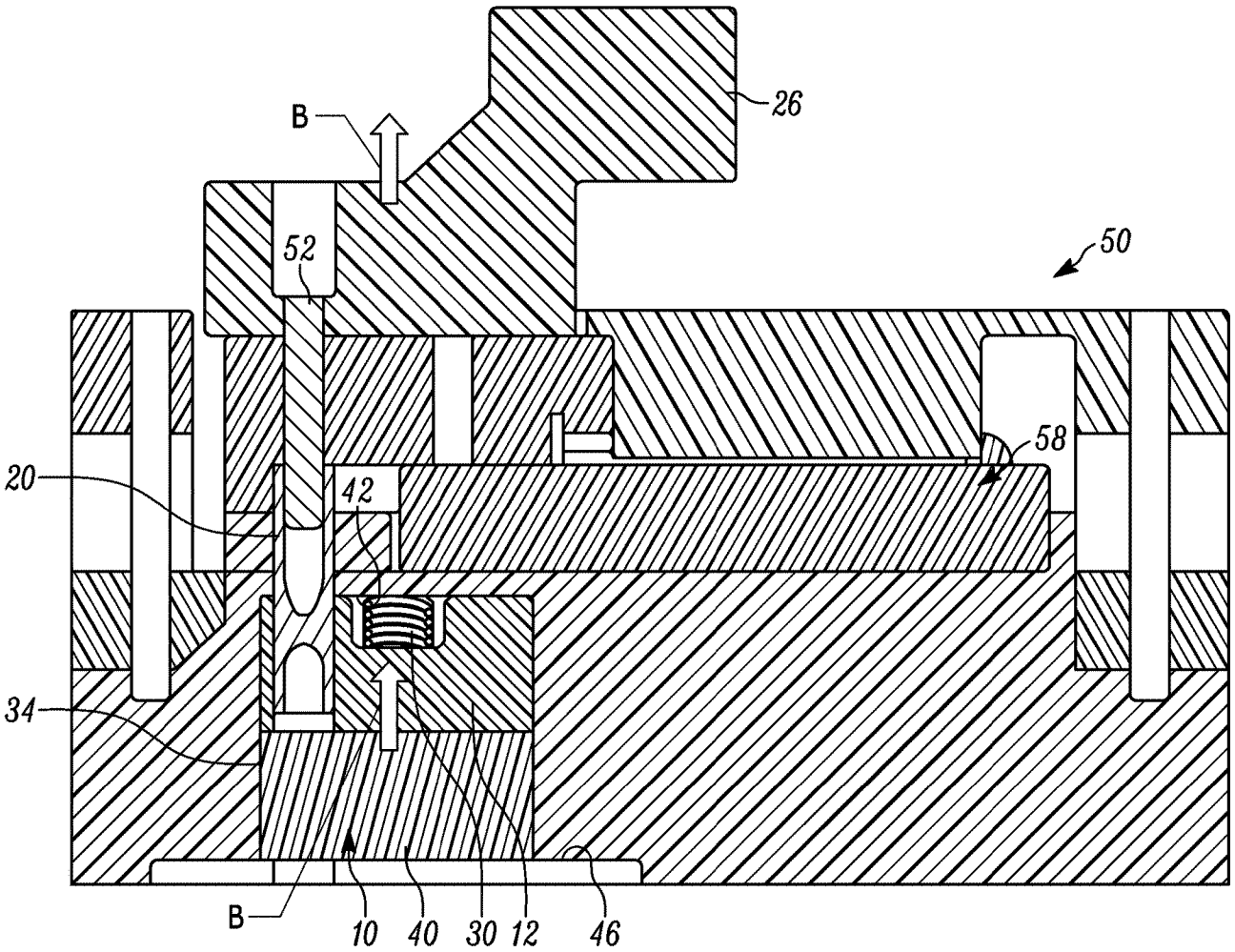
FIG. 4 is cut-away view of a DC outlet showing movement of the sliding contact of FIG. 3 before plug separation and during a disconnecting process of the plug.
Figure 5:
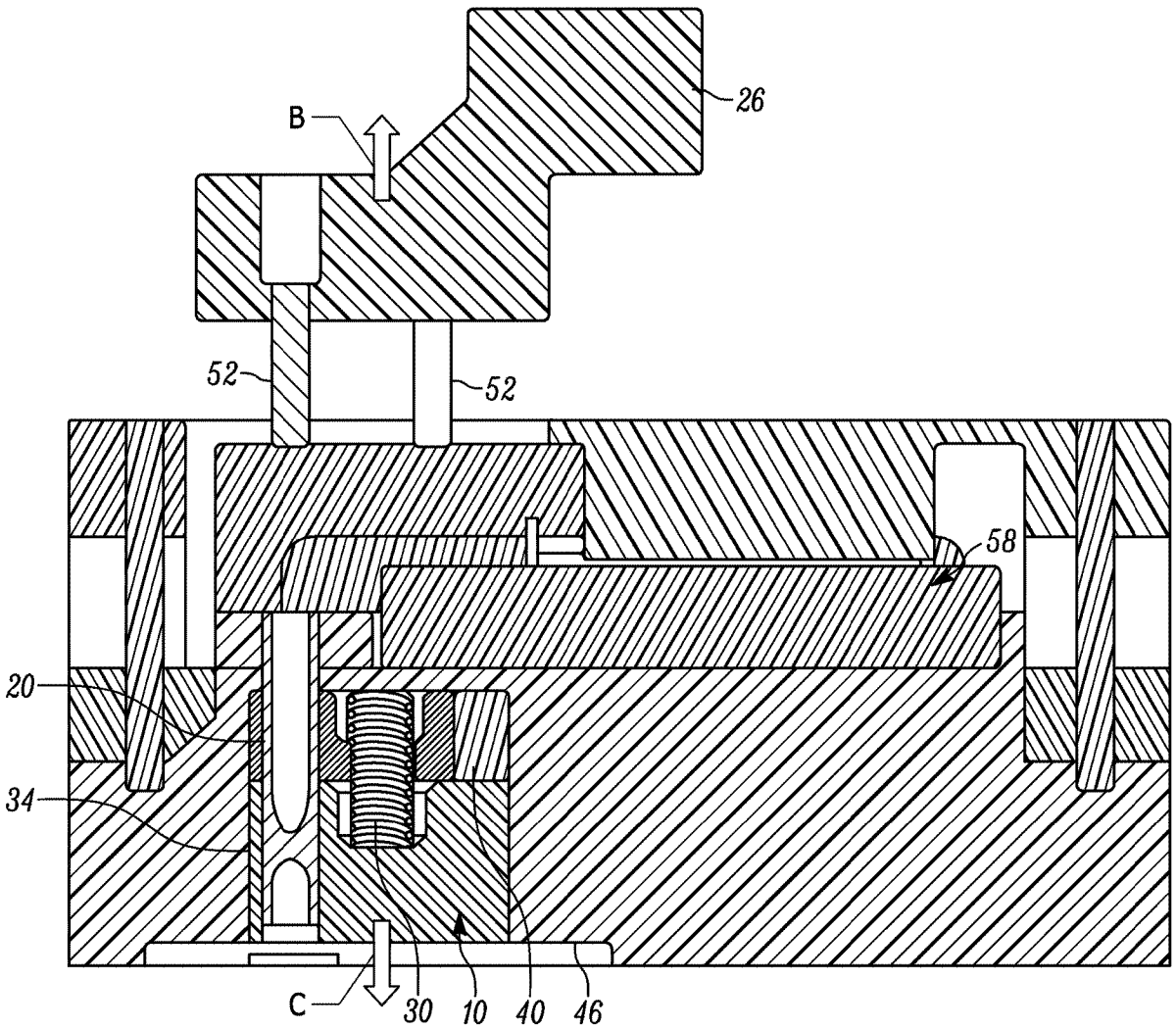
FIG. 5 is cut-away view showing movement of the sliding contact of FIG. 4 after plug separation and during a disconnecting process of the plug.

FIG. 3 to FIG. 5 illustrate how the sliding contact structure assembly 36 operates within a DC socket outlet 50 and with respect to an electrical plug 26. The housing 34 is coupled to a fixed portion 48 of the outlet 50, a wall or any fixed structure associated with the outlet 50 so that the sliding contacts 20 are accessible to the plug contacts 52. FIG. 3 shows the position when the plug 26 is being electrically connected with the sliding contacts 20 of the sliding contact assembly 36. The sliding contacts 20 define the outlet contacts of the electrical socket outlet 50. As the plug 26 is moved in the direction of arrow A, the spring 30 is partially compressed between the top surface 42 and a surface 44 of the base 12. The spring 30 thus biases the sliding contact structure 10 so as to engage the bottom surface 46 of the stationary housing 34. When the plug 26 is being connected into the socket outlet 50, due to the friction force between the plug contacts 52 and the sliding contacts 20 in the outlet side, the sliding contact structure 10 trends to move in the same direction as that of plug 26 (towards the bottom of the socket outlet 50). However, the bottom surface 46 of the stationary housing 34 constrains the movement of the sliding contacts 20 during the connection process and provides the force to balance the plug friction force. Therefore, the sliding contacts 20 remain stationary and the spring 30 does not need to provide the force to overcome the friction force between the plug side and outlet side contacts.

As shown in FIG. 3, when the plug 26 is connected with the sliding contacts structure 10, a surface 54 of the plug 26 engages a top surface 56 of the socket outlet 50. It is noted that although one sliding contact 20 and one plug contact 52 is shown in FIG. 3 to FIG. 5, there are typically 3 sliding contacts 20 (FIG. 1) and thus three associated plug contacts 52. The spring 30 and sliding contact structure 10 remain in the same position shown in FIG. 3 when the plug is not connected, during process of plug connection, and after connection of the plug contacts with the sliding contacts 20.

FIG. 4 illustrates the process when the plug 26 is in the course of disconnection but not separated from the socket outlet 50. In the embodiment, the spring force between the plug contacts 52 and the sliding contacts 20 in the socket outlet side is used to compress the spring 30 and store the energy to accelerate the separation speed after the sliding contacts 20 are released. In order to utilize the friction force, the following condition must be guaranteed, $$F_{contacts\ friction,min.} > F_{spring,max} + F_{resistance,max} \quad (1)$$

where $F_{contacts\ friction,\ min.}$ is the minimal friction force between the plug contacts 52 and the sliding contacts 20, $F_{spring,\ max}$ is the maximal spring force in the process of the compression, and $F_{resistance,\ max}$ is the maximal resistance force when the sliding contacts 20 are moving, for example, the friction between the base 12 and the side wall structure 47 (FIG. 2). Due to relationship (1), the sliding contacts structure 10 will move together with the plug 26 (in the direction of arrows B) when the plug 26 is in the process of removal but not separated from the sliding contacts 20. In the meanwhile, the spring 30 is compressed all the way until the body 12 is constrained by the top surface 42 and cannot move any further towards the plug movement direction B.

In the above mentioned stage, the relative position between the plug contacts 52 and sliding contacts 20 may remain unchanged. When the plug 26 continues to disconnect, the plug contacts 52 are sliding out from the sliding contacts 20 because the latter cannot move further in the direction B. This stage is completed at the moment when the plug contacts 52 are separated from the sliding contacts. But within the stage, relationship (1) guarantees the spring 30 is compressed most and the spring force is maintained at the maximal value and ready for the accelerated separation in the next stage.

FIG. 5 shows the stage after the sliding contacts 20 are released from the plug contacts 52. Once disengaged, there is no friction force between the plug contacts 52 and the sliding contacts 29 and thus the sliding contact structure 10 is biased by the compressed spring 30 and pushed rapidly so as to rapidly separate the plug contacts 52 from the sliding contacts 20. The speed of movement of the sliding contact structure 10 is accelerated by the energy stored in the spring 30. Arcing occurs after the plug contacts 52 are separated from the sliding contacts 20. Addition separation speed between the plug 26 and outlet contacts 20 is obtained because the sliding contact 20 are pushed back, in the direction of arrow C, rapidly by the spring 30, with the base 12 engaging the bottom surface 46 of the housing 34. As a result, much higher relative separation speed between the plug 26 and outlet contacts 20 can be obtained that helps to mitigate the arcing energy.

During this stage when the spring 30 pushes the sliding contact structure 10 in the oppose direction of plug removal, the relative speed can be described by, $$S_{separation}=S_{sliding\ contacts}+S_{plug\ removal} \quad (2)$$

where $S_{separation}$ is the relative separation speed between the plug contacts 52 and the sliding contacts 20 which has important impact on the arcing energy mitigation, $S_{sliding\ contacts}$ is the speed of the sliding contacts 20 obtained by the spring 30, and $S_{plug\ removal}$ is the speed of the plug 26 when it is removed from the socket outlet 50 and usually it is determined by the user who operates the device.

Based on formula (2), since $S_{sliding\ contacts}$ can be guaranteed by the configuration of the sliding contact structure 10 disclosed herein, the minimal value of the relative separation speed $S_{separation}$ can also be guaranteed no matter the value of $S_{plug\ removal}$. Typically $S_{plug\ removal}$ is uncontrolled, random and highly dependent on the user. With the disclosed method, the minimal relative separation speed doesn't rely on the uncontrolled plug removal speed. Instead, it is guaranteed by the speed of the sliding contact structure 10 in the socket outlet side.

It can be appreciated that instead of providing one, centrally located spring 30, multiple springs can be used to provide design flexibility. For example, a pair of springs can be used or one spring can be associated with each of the three sliding contacts 20. All of these embodiments address the issue of the minimal separation speed required to quench DC arcing in a LVDC socket outlet. It can also be appreciated that the plug 26 can have female contacts when the sliding contacts are formed as male contacts.

Figure 6:
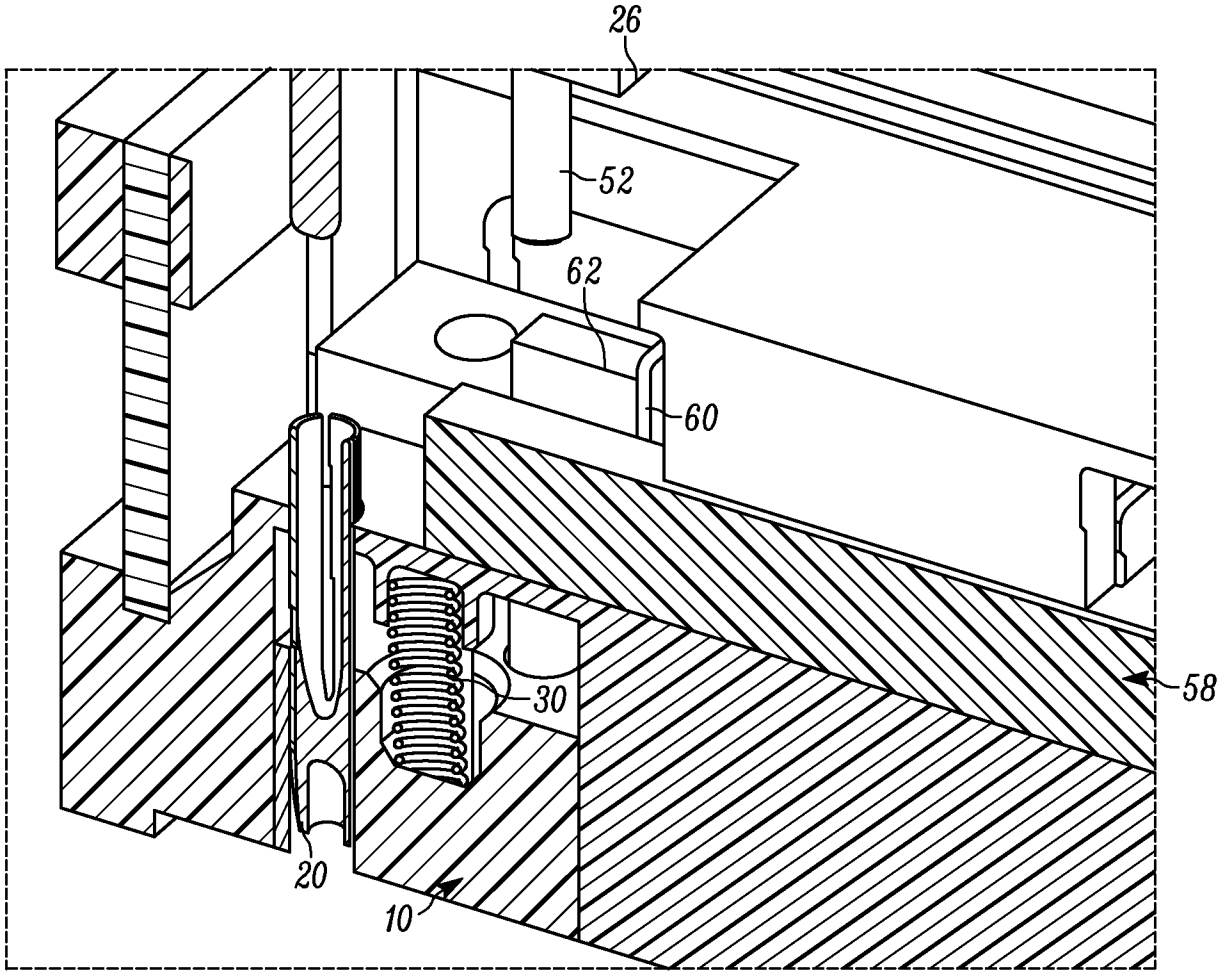
FIG. 6 is a partial perspective view showing an electromagnet assembly as part of the DC outlet.

FIG. 6 shows the DC socket outlet 50 where the electromagnet assembly 58 is shown clearly, the electromagnet assembly includes a standard coil 60 wound on a leg 62. The electromagnetic field of the electromagnet assembly 58 can be applied to the arcing zone between the sliding contacts 20 and the plug contacts 52 such that both Lorenz force created by the magnetic field and high separation speed created by the sliding contacts assembly together minimize arcing. The electromagnet assembly 58 is an optional component of the socket outlet 50.

The sliding contact assembly 36 is compact and very simple in construction. The assembly 36 is compatible with the NEMA standards requirement (in the case of AC receptacle). There is no need to change the dimension of the receptacle front cover which is defined by the NEMA standards. The assembly 36 may require additional depth to implement the sliding outlet contacts in the socket outlet, but such is allowed by the standards. The assembly 36 is cost effective. No complex structure, components or additional mechanical switch with associated spring mechanism is required. The assembly 36 utilizes the friction force between the plug contacts and the outlet contacts, which is standardized in the case of an AC receptacle (e.g. 30N). The assembly allows the change of the friction force between the contacts, as long as it is larger than the maximal spring force. High separation speed can be achieved with the assembly 36 since the mass of the sliding contacts 20 is small and the required spring 30 doesn't need to be strong.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A sliding contact assembly for a DC electrical outlet, the sliding contact assembly being constructed and arranged to receive plug contacts of an electrical plug, the sliding contact assembly comprising:

sliding contact structure comprising a base and a plurality of electrical sliding contacts fixed to the base, a housing including a first end wall having an internal top surface and second end wall opposing the first end wall, the second end wall having an internal bottom surface, the housing having side wall structure defining an internal chamber between the top surface and the bottom surface, the sliding contact structure being disposed in the housing so as be movable linearly within the chamber, and at least one spring disposed between the top surface of the housing and a surface of the base, wherein the at least one spring is configured to (i) bias the sliding contact structure into engagement with the bottom surface of the housing in response to friction between the plug contacts and the plurality of electrical sliding contacts, (ii) store energy in response to the friction between the plug contacts and the plurality of electrical sliding contacts as the plug contacts are in the process of being disconnected from the plurality of electrical sliding contacts, and (iii) release the stored energy to cause the plurality of electrical sliding contacts to rapidly move away from the plug contacts once the plug contacts are completely disconnected from the plurality of electrical sliding contacts.

2. The assembly of claim 1, wherein the base has a plurality of cut-outs therein and a boss is provided in each cut-out, each boss being fixed to the base, and wherein each boss includes an opening receiving one of the plurality of sliding contacts.

3. The assembly of claim 2, wherein each sliding contact is secured in the associated boss by a fastener.

4. The assembly of claim 1, wherein each of the plurality of sliding contacts is a female contact.

5. The assembly of claim 4, wherein each female sliding contact is a metal hollow tubular member having an open end for receiving an associated male plug contact of the electrical plug.

6. The assembly of claim 5, in combination with the electrical plug having the male plug contacts.

7. The assembly of claim 1, wherein the at least one spring comprises a coil spring disposed along a central axis of the base.

8. The assembly of claim 7, wherein an outer periphery of the base and the side wall structure are each generally cylindrical.

9. The assembly of claim 1, wherein the side wall structure and the first and second end walls define the internal chamber as a substantially closed chamber.

10. The assembly of claim 9, wherein at least the first end wall has openings therein for each sliding contact to pass there-through.

11. The assembly of claim 6, in further combination with the DC electrical outlet, the outlet having an electromagnet assembly constructed and arranged to generate an electromagnetic field applied to an arcing zone between the sliding contacts and the plug contacts.

12. A method of rapidly separating outlet contacts from plug contacts of an electrical plug at a DC electrical outlet, the DC electrical outlet comprising (i) a sliding contact structure having a base and a plurality of electrical sliding contacts fixed to the base and defining the outlet contacts, (ii) a housing defining an internal chamber with the sliding contact structure being disposed in the housing so as be movable linearly within the chamber, (iii) a fixed member associated with the DC electrical outlet and coupled to the housing such that the housing remains stationary and sliding contacts are accessible to the plug contacts, and (iv) at least one spring disposed between the housing and a surface of the base, the method comprising:

engaging the plug contacts with the plurality of electrical sliding contacts such that friction between the plug contacts and the plurality of electrical sliding contacts partially compresses the at least one spring to bias the sliding contact structure to engage an internal bottom surface of the housing, disengaging the plug contacts partially from the plurality of electrical sliding contacts while the friction between the plug contacts and the plurality of electrical sliding contacts further compresses the at least one spring, and disengaging the plug contacts completely from the plurality of electrical sliding contacts to allow the compressed spring to rapidly force the plurality of electrical sliding contacts away from the plug contacts.

13. The method of claim 12, wherein the housing includes a first end wall having an internal top surface and second end wall opposing the first end wall, the second end wall defining the internal bottom surface and wherein the housing is provided with a side wall structure defining the internal chamber between the top surface and the bottom surface.

14. The method of claim 12, wherein each of the plurality of sliding contacts is provided as a female contact.

15. The method of claim 14, wherein each female sliding contact is provided as a metal hollow tubular member having an open end for receiving an associated male plug contact of the electrical plug.

16. The method of claim 12, wherein the at least one spring is provided as coil spring disposed along a central axis of the base.

17. The method of claim 16, wherein an outer periphery of the base and the side wall structure are each provided to be generally cylindrical.

18. The method of claim 13, wherein the side wall structure and the first and second end walls define the internal chamber as a substantially closed chamber and wherein at least the first end wall is provided with openings therein for each sliding contact to pass there-through.

19. The method of claim 12, wherein the base is provided with a plurality of cut-outs therein and a boss is provided in each cut-out, each boss being fixed to the base, and wherein each boss includes an opening receiving one of the plurality of sliding contacts.

20. The method of claim 12, wherein an electromagnet assembly is provided in the DC electrical outlet, the method further comprising:

generating an electromagnetic field at an arcing zone between the sliding contacts and the plug contacts.

* * * * *